US007001494B2

(12) United States Patent
Jovic et al.

(10) Patent No.: US 7,001,494 B2
(45) Date of Patent: Feb. 21, 2006

(54) ELECTROLYTIC CELL AND ELECTRODES FOR USE IN ELECTROCHEMICAL PROCESSES

(75) Inventors: Vladimir Jovic, Serbia (YU); Michel Barsoum, Moorestown, NJ (US)

(73) Assignee: 3-One-2, LLC, Voorhees, NJ (US)

( * ) Notice: Subject to any disclaimer, the term of this patent is extended or adjusted under 35 U.S.C. 154(b) by 528 days.

(21) Appl. No.: 10/217,932

(22) Filed: Aug. 13, 2002

(65) Prior Publication Data

US 2003/0042136 A1 Mar. 6, 2003

Related U.S. Application Data

(60) Provisional application No. 60/312,334, filed on Aug. 14, 2001.

(51) Int. Cl.
*C25B 9/00* (2006.01)

(52) U.S. Cl. ..... 204/252; 204/263; 204/264; 204/265; 204/266

(58) Field of Classification Search ..... 204/247.3, 204/243.1, 291, 279, 294, 252, 263, 264, 204/265, 266; 205/380, 385, 387
See application file for complete search history.

(56) References Cited

U.S. PATENT DOCUMENTS

| | | | | |
|---|---|---|---|---|
| 1,915,473 | A | 6/1933 | Raney | |
| 3,616,445 | A | 10/1971 | Bianchi et al. | 204/290 F |
| 3,950,240 | A | 4/1976 | Cookfair et al. | 204/290 F |
| 4,007,107 | A | 2/1977 | Johnson | 204/290 F |
| 4,107,025 | A | 8/1978 | Loutfy et al. | 204/290 F |
| 4,116,804 | A | 9/1978 | Needes | 204/284 |
| 4,401,529 | A | 8/1983 | Gray | 204/95 |
| 4,425,203 | A | 1/1984 | Gray | 204/129 |
| 4,430,186 | A | 2/1984 | Gray | 204/242 |
| 4,466,868 | A | 8/1984 | Gray | 204/95 |
| 4,511,442 | A | 4/1985 | Pellegri | 204/98 |
| 4,975,161 | A | 12/1990 | Nidola et al. | 204/98 |
| 5,324,395 | A | 6/1994 | Paul et al. | 204/98 |
| 5,395,422 | A | 3/1995 | Schulz et al. | 75/255 |
| 5,433,797 | A | 7/1995 | Erb et al. | 148/304 |
| 5,492,732 | A | 2/1996 | Paul et al. | 427/453 |
| 5,578,176 | A | 11/1996 | Hardee et al. | 204/290 R |
| 5,587,058 | A | 12/1996 | Gorodetsky et al. | 204/290 F |
| 5,676,807 | A * | 10/1997 | de Nora et al. | 204/243.1 |
| 6,019,878 | A | 2/2000 | Nidola et al. | 204/290 F |
| 6,312,570 | B1 * | 11/2001 | Mroz, Jr. | 204/247.3 |
| 6,497,922 | B1 * | 12/2002 | Knight et al. | 427/450 |

OTHER PUBLICATIONS

F. M. Berkey, "Electrolysis of Hydrochloric Acid Solutions", Ch. 7 in "Chlorine its Manufacture, Properties and Uses", Ed. J. S. Sconce, New York, Reinhold Publishing Corp., 1962, no month.

* cited by examiner

*Primary Examiner*—Bruce F. Bell
(74) *Attorney, Agent, or Firm*—Licata & Tyrrell P.C.

(57) ABSTRACT

An electrolytic cell with an anode and cathode for the electrolysis of hydrochloric acid and brine is provided. The anodes and cathodes of the present invention are made of a bulk ceramic or intermetallic material.

7 Claims, 3 Drawing Sheets

ELECTROLYTIC CELL AND ELECTRODES FOR USE IN ELECTROCHEMICAL PROCESSES

This application claims the benefit of priority from U.S. Provisional Application Ser. No. 60/312,334, filed Aug. 14, 2001, which is herein incorporated by reference in its entirety.

FIELD OF INVENTION

This invention relates to electrolytic cells and their use in hydrogen and chlorine evolution. This invention also relates to electrodes for use in electrolytic cells and in hydrogen and chlorine evolution. Methods for electrolysis of hydrochloric acid solutions, alkali metal halide solutions and alkaline solutions in electrolytic cells using the electrodes of this invention are also provided.

BACKGROUND

In certain industrial operations hydrochloric acid is formed as a by-product of chlorination. There is usually no immediate market for the hydrochloric acid. The lack of a market makes hydrochloric acid production problematic in that it cannot be dumped into sewers and wastewater outlets without costly neutralization. It has been customary in industry to utilize electrolysis of hydrochloric acid to overcome disposal issues. Electrolysis of brines and hydrochloric acid are completed within an electrolytic cell with an anode and a cathode. An electrical potential is established between the anode and the cathode whereby the negatively charged chloride ions are attracted to the anode. Monoatomic chlorine atoms combine at the anode to form diatomic chlorine molecules. In such chlorine production the chlorine molecules form gas bubbles on the surface of the anode and chlorine is recovered as a gas. Monoatomic hydrogen atoms combine at the cathode to form diatomic hydrogen molecules as gas bubbles on the surface of the cathode and hydrogen is also recovered as a gas.

As a consequence of the significant increases in energy costs and the increased scarcity of industrial fuel supplies, intensive research in the field of electrolysis has been performed in order to reduce the amount of power used in industrial electrolysis processes. The cost of electrolysis is proportional to the voltage at which the electrolysis is effected. Thus, it is desirable to reduce the amount of voltage at which a solution is electrolyzed to as low of a value as possible. Methods and apparatuses described in the prior art for achieving a low hydrogen over-voltage include the following:

U.S. Pat. Nos. 1,915,473 and 4,116,804 describe various methods for producing "Raney nickel", an active porous nickel which provided one of the first alternative cathodic materials to mild steel. This alternative material is used to produce exceptionally low over-voltage as compared to steel cathodes.

U.S. Pat. No. 4,401,529 describes an improved hydrogen evolution cathode of the same type as "Raney nickel" with addition of molybdenum to produce NiMo "Raney nickel" surface.

U.S. Pat. Nos. 4,425,203, 4,430,186 and 4,466,868 describe the addition of small amounts of from 1 to 5 percent of Ti to NiMo alloy which was found to reduce over-voltage for hydrogen evolution in alkaline solutions in comparison with that of the NiMo alloy in Raney nickel.

U.S. Pat. No. 4,975,161 describes hydrogen evolution cathodes produced by thermal decomposition of a mixture of elements of the groups IB, IIB, IIIA, IVA, VA, VIA, VIB and VIII of the Periodic Table.

U.S. Pat. No. 5,395,422 describes the process of producing nanocrystalline metallic powders containing Ni, Co, and Fe or mixtures thereof while the alloying element is one or more transition metals such as Mo, W or V, to be used as catalytic materials for hydrogen evolution.

U.S. Pat. Nos. 5,324,395 and 5,492,732 describe plasma spray techniques for obtaining durable low hydrogen over-voltage cathodes bearing a coating which has an outer layer with at least 10 percent of cerium oxide and at least one non-noble Group VIII metal.

U.S. Pat. No. 5,433,797 describes another type of cathode for hydrogen evolution, the design of which is based on the use of nanocrystalline metals of average grain size and less than about 11 nanometers of tertiary and quaternary NiFeCr and NiFeCrMn alloys. This cathode is obtained by electrodeposition using pulsating direct current regimes.

U.S. Pat. No. 3,616,445, describes electrodes made of titanium, known as "dimensionally stable anodes" (DSA). The introduction of DSA into the processes of chlorine, chlorate and hypochlorite production by the electrolysis of brine has led to significant decreases in energy costs. DSA are made of titanium coated with a thermally prepared mixture of $TiO_2$ and $RuO_2$. DSA are corrosion resistant, selective to chloride ion oxidation and exhibit a high catalytic activity. However, the coating must be routinely replaced.

U.S. Pat. No. 3,950,240 describes a procedure of obtaining a catalytic coating of tin oxide with niobium and a relatively small amount of noble metal oxides. This procedure is advantageous over DSA as smaller amounts of expensive noble metal oxides are required.

U.S. Pat. Nos. 4,511,442, 4,107,025 and 4,007,107 describe metal coated anodes. U.S. Pat. No. 5,587,058 describes electrodes with better corrosion resistance than DSA in the process of chlorine production.

U.S. Pat. Nos. 3,486,994 and 4,210,501 describe production of chlorine by electrolysis of hydrochloric acid in an electrolytic cell having anolyte and catholyte chambers. U.S. Pat. No. 3,242,065 describes production of chlorine from hydrochloric acid using an electrolytic cell with the graphite cathode attached to the frame of the cell. U.S. Pat. No. 5,770,035 describes a method for the production of chlorine from hydrochloric acid in a electrolytic cell, with a cathode compartment equipped with a gas diffusion cathode fed with air, enriched air or oxygen.

U.S. Pat. No. 4,959,132 describes a process of fabrication of thin, electronically conductive, high-surface area film formed on both sides of a membrane to form a bipolar structure useful for electrolysis of hydrochloric acid.

U.S. Pat. No. 5,580,437 describes a particular anode for conversion of hydrochloric acid into chlorine gas using an electrochemically active material of tin, germanium or lead, or mixtures thereof.

U.S. Pat. No. 6,066,248 describes a process for the electrolysis of aqueous hydrochloric acid solution in an electrochemical flow reactor with a solid polymer electrolyte membrane, a platinum-based anode, a cathode and backings.

A number of commercial processes of electrolysis of hydrochloric acid for production of chlorine have been developed (see e.g. F. R. Minz, "HCl—electrolysis—Technology for Recycling Chlorine", Bayer AG, Conference on Electrochemical Processing, Innovation & Progress, Glasgow, Scotland, UK Apr. 21–23, 1993). A currently employed commercial electrochemical process is known as the Uhde process. In this process aqueous HCl solution of approximately 22 percent is fed at 65 to 70 degrees Celsius into an electrochemical cell into both the anodic and cathodic compartments which are divided by a diaphragm made of special type of PVC cloth. Graphite is used as electrode material for both, anode and cathode (bipolar electrode). Exposure to a direct current in the cell results in an electrochemical reaction and a decrease in HCl concentration of up to 17 percent with the production of chlorine gas in the anodic compartment and hydrogen in the cathodic compartment. Both the anode and cathode side of a graphite bipolar electrode, undergo severe destruction after operating for some time in a cell for hydrochloric acid electrolysis (F. M. Berkey, "Electrolysis of Hydrochloric Acid Solutions", Ch. 7 in "Chlorine its Manufacture, Properties and Uses", Ed. J. S. Sconce, New York, Reinhold Publishing Corp., 1962). The use of DSA in this process is not recommended since the titanium substrate undergoes significant corrosion in concentrated HCl at high temperatures and the electrode becomes unusable after a short operating time. Other materials stable in hydrochloric acid like platinum group metals are excessively expensive.

The present invention provides an electrolytic cell which utilizes electrodes exhibiting high stability in acidic media, particularly in concentrated hydrochloric acid. The electrodes have a corrosion rate of less than 2 ìm per year. The electrodes also exhibit low over-voltage for hydrogen and chlorine evolution. Methods of their use as cathodes and anodes in production of chlorine by electrolysis of hydrochloric acid and brine are also provided.

SUMMARY OF THE INVENTION

An object of the present invention is to provide an electrolytic cell with a cathode and an anode, wherein the cathode is made of a bulk ceramic or intermetallic material.

Another object of the present invention is to provide an electrolytic cell with a cathode and an anode, wherein the cathode comprises a layer of ceramic or intermetallic material thermally sprayed on a material suitable for formation of a cathode.

Another object of the present invention is to provide an electrolytic cell anode for the electrolysis of hydrochloric acid solutions wherein the electrolytic cell anode comprises a bulk ceramic or intermetallic material activated by a thin layer of a thermally prepared mixture of $TiO_2$ and $RuO_2$, or $TiO_2$, $RuO_2$ and $IrO_2$.

Another object of the present invention is to provide an electrolytic cell anode for the electrolysis of hydrochloric acid solutions wherein the electrolytic cell anode comprises a bulk ceramic or intermetallic material containing Ti and activated upon addition of Ru, or Ru and Ir.

Another object of the present invention is to provide an electrolytic cell cathode for the electrolysis of hydrochloric acid solutions wherein the electrolytic cell cathode comprises a bulk ceramic or intermetallic material.

Another object of the present invention is to provide an electrolytic cell cathode for the electrolysis of hydrochloric acid solutions wherein the electrolytic cell cathode comprises a layer of ceramic or intermetallic material thermally sprayed on a material suitable for formation of a cathode.

Another object of the present invention is to provide a method for electrolysis of hydrochloric acid solutions, alkaline solutions and alkali metal halide solutions using the electrolytic cell of this invention.

DETAILED DESCRIPTION

Figure 1:
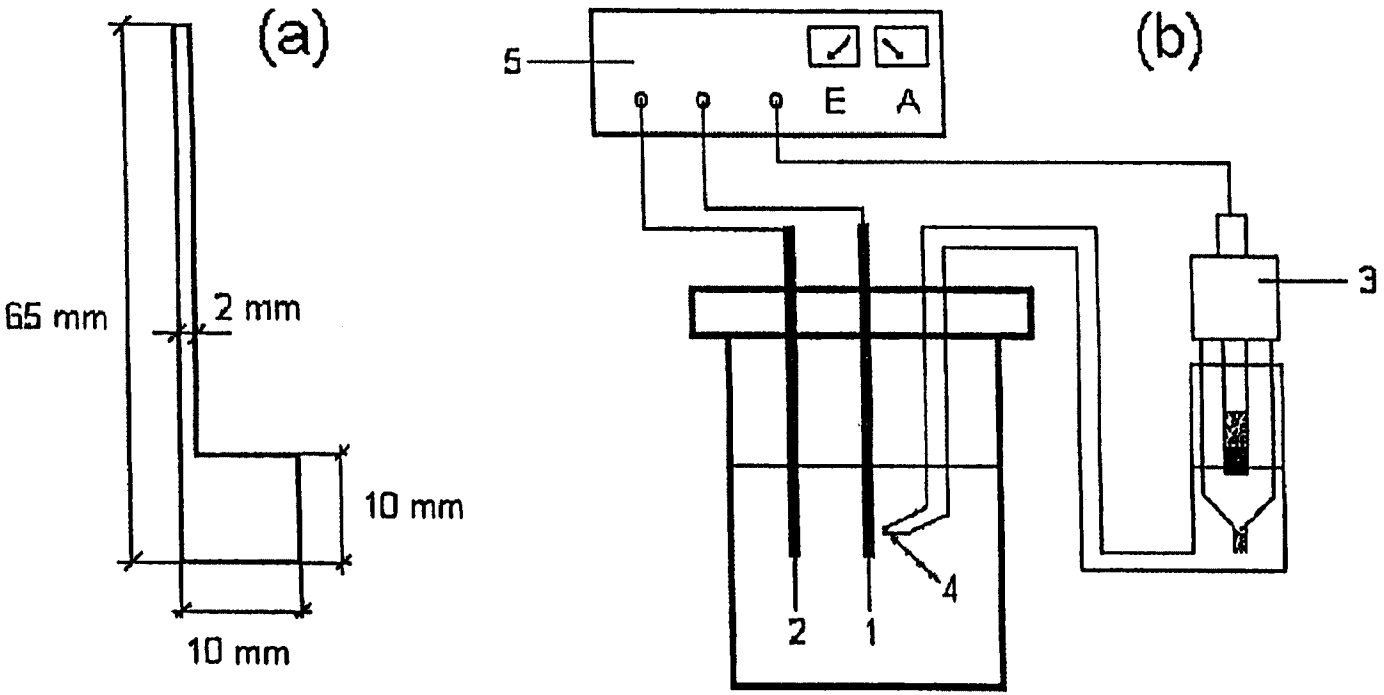
FIG. 1(*a*) shows a drawing of the shape and dimensions of a test electrode, while FIG. 1(*b*) shows an electrolytic cell and apparatus used for polarization measurements.

The present invention relates to an electrolytic cell with electrodes useful in electrochemical processes. The present invention also relates to cathodes and anodes useful for hydrogen evolution in cells for the electrolysis of hydrochloric acid solutions, alkali metal halide solutions, and alkaline solutions.

The cathodes of the present invention comprise either a bulk or plasma sprayed electrocatalytic ceramic or intermetallic material of the composition $M_{n+1}AX_n$ (n=1,2,3) wherein M is a metal selected from group IIIB, IVB, VB, VIB or VIII of the periodic table of elements and/or a mixture thereof; wherein A is selected from group IIIA, IVA, VA or VIA of the periodic table of elements and/or a mixture thereof; and wherein X is carbon and/or nitrogen. In a preferred embodiment the electrode comprises $Ti_3SiC_2$. Any of these materials or their solid solutions may be activated by a thermally prepared coating of a solid solution of $TiO_2$ and $RuO_2$ or $TiO_2$, $RuO_2$ and $IrO_2$, while materials containing Ti can be activated by the addition of Ru or by the addition of Ru and Ir in the bulk ceramic or intermetallic material and subsequent oxidation in order to obtain an electrocatalytic layer composed of a solid solution of $TiO_2$ and $RuO_2$ or $TiO_2$, $RuO_2$ and $IrO_2$. These materials can be used as anodes for chlorine evolution in cells for the electrolysis of hydrochloric acid solutions. These materials, particularly $Ti_3SiC_2$, possess high stability in acidic media, particularly in concentrated hydrochloric acid solution, with the corrosion rate being lower than 2 $\mu$m per year. The electrodes of the present invention are preferably composed of the compound $Ti_3SiC_2$. In a more preferred embodiment of the present invention, the electrode comprises a $(TiRu)_3SiC_2$ or $(TiRuIr)_3SiC_2$ solid compound which may be oxidized after fabrication in order to form an electrocatalytic layer composed of a solid solution of $TiO_2/RuO_2$ and/or $TiO_2/RuO_2/IrO_2$. This oxidation is performed prior to use of the electrode as the anode in an electrolytic cell for chlorine production from hydrochloric acid.

In one aspect, the present invention provides an electrolytic cell comprising a cathode and an anode. In one embodiment, the cathode of the electrolytic cell comprises a cathodic bulk ceramic or intermetallic material. The cathodic bulk ceramic or intermetallic material comprises the composition $M_{n+1}AX_n$ (n=1,2,3) wherein M is a metal selected from group IIIB, IVB, VB, VIB or VIII of the periodic table of elements and/or a mixture thereof; wherein A is selected from group IIIA, IVA, VA or VIA of the periodic table of elements and/or a mixture thereof; and wherein X is carbon and/or nitrogen. The cathodic bulk ceramic material possesses high stability in acidic media with a corrosion rate of less than 2 $\mu$m per year and low over-voltage for hydrogen evolution.

Alternatively, the electrolytic cell cathode may comprise a material which is suitable for formation of a cathode that is coated, preferably via thermal spraying, with the ceramic or intermetallic material to thicknesses from about 100 $\mu$m to about 1 mm. An example of a material suitable for formation of a cathode is steel. However, other materials known to those of skill in the art for use in formation of cathodes can also be used.

Another aspect of the present invention relates to an electrolytic cell anode for the electrolysis of hydrochloric acid solutions with a bulk ceramic or intermetallic material of the composition $M_{n+1}AX_n$ wherein M is a metal selected from group IIIB, IVB, VB, VIB or VIII of the periodic table of elements and/or a mixture thereof; wherein A is selected from group IIIA, IVA, VA or VIA of the periodic table of elements and/or a mixture thereof; and wherein X is carbon and/or nitrogen, activated by a catalytic thermally prepared coating containing a solid solution of $TiO_2/RuO_2$ and/or $TiO_2/RuO_2/IrO_2$.

Another aspect of the present invention relates to an electrolytic cell anode for the electrolysis of hydrochloric acid solutions with a bulk ceramic or intermetallic material of the composition $Ti_{n+1}AX_n$ wherein A is selected from group IIIA, IVA, VA or VIA of the periodic table of elements and/or a mixture thereof; and wherein X is carbon and/or nitrogen, activated by addition of Ru or Ru and Ir in the bulk ceramic material and subsequent oxidation. In a preferred embodiment, the anode comprises a composition of $(TiRu)_3SiC_2$ or $(TiRuIr)_3SiC_2$ which is oxidized after fabrication in order to form an electrocatalytic layer made of a solid solution of $TiO_2$ and $RuO_2$, or $TiO_2$, $RuO_2$ and $IrO_2$.

The present invention also relates to a method for electrolysis of hydrochloric acid solutions, alkaline solutions, and alkali metal halide solutions. In this method, the solution is fed into cathodic and anodic compartments of an electrolytic cell which are divided by a diaphragm or membrane. Multiple solutions may be used. For example, in the case of alkali metal halide electrolysis, 33 percent by weight NaOH is used as the catholyte, while 300 g/l NaCl is used as the anolyte. A sufficient amount of voltage is then administered to the cell to electrolyze the solution. In this method, the cathode comprises a cathodic bulk ceramic or intermetallic material and/or a cathode that is coated, preferably via thermal spraying with a catalytic ceramic or intermetallic material. The cathodic ceramic or intermetallic material comprises the composition $M_{n+1}AX_n$ wherein M is a metal or mixture of metals from group IIIB, IVB, VB, VIB or VIII of the periodic table of elements; wherein A is an element from group IIIA, IVA, VA or VIA of the periodic table of elements or a mixture thereof; and wherein X is carbon and/or nitrogen. The anode used in this method comprises a bulk ceramic or intermetallic material of the composition $M_{n+1}AX_n$ wherein M is a metal or a mixture of metals from group IIIB, IVB, VB, VIB or VIII of the periodic table of elements; wherein A is an element from group IIIA, IVA, VA or VIA of the periodic table of elements or a mixture thereof; and wherein X is carbon and/or nitrogen, activated by a catalytic thermally prepared coating containing a mixture of $TiO_2$ and $RuO_2$, or $TiO_2$, $RuO_2$ and $IrO_2$. The anode used in this method also comprises a bulk ceramic or intermetallic material of the composition $Ti_{n+1}AX_n$ wherein A is from group IIIA, IVA, VA or VIA of the periodic table of elements and/or a mixture thereof; and wherein X is carbon and/or nitrogen, activated by addition of Ru or Ru and Ir in the bulk ceramic or intermetallic material and subsequent oxidation. The anodes of the present invention have low over-voltage for chlorine evolution compared to the over-voltage for chlorine evolution of other commercial materials. The anodes and cathodes of the present invention are resistant to corrosion in hydrochloric acid solutions. A catalytic thermally prepared coating containing a mixture of $TiO_2$ and $RuO_2$, or $TiO_2$, $RuO_2$ and $IrO_2$ is preferred.

FIG. 1(*a*) shows a drawing of the shape and dimensions of a test electrode. FIG. 1(*b*) shows an electrolytic cell with a cathode and anode used for recording polarization curves, the test electrode 1, and the counter (Pt) electrode 2, are connected to the potentiostat 5. The reference electrode (SCE) 3, is connected to the potentiostat 5 at one end, and to the Luggin capillary 4 at the other end. Cathodes and anodes were worked out of a plate of 2.5 mm. Total electrode surface area immersed in the solution was 2.75 $cm^2$.

Electrodes of the present invention including bulk $Ti_3SiC_2$ electrodes, and plasma sprayed $Ti_3SiC_2$ electrodes were compared with commercial graphite electrodes in 22 percent hydrochloric acid solution. Electrodes of the present invention were shaped in accordance with FIG. 1. The commercial graphite cathodes were mechanically polished with fine emery paper (#800) and thoroughly rinsed with distilled water. The bulk $Ti_3SiC_2$ cathode of the present invention (namely a $Ti_3SiC_2$ cathode) was also mechanically polished on fine emery paper (#800), thoroughly rinsed with distilled water and cleaned in 10 percent $HNO_3$ for 10 minutes. A plasma sprayed $Ti_3SiC_2$ cathode was cleaned in 10 percent $HNO_3$ for 10 minutes before use in the electrochemical cell.

Figure 2:
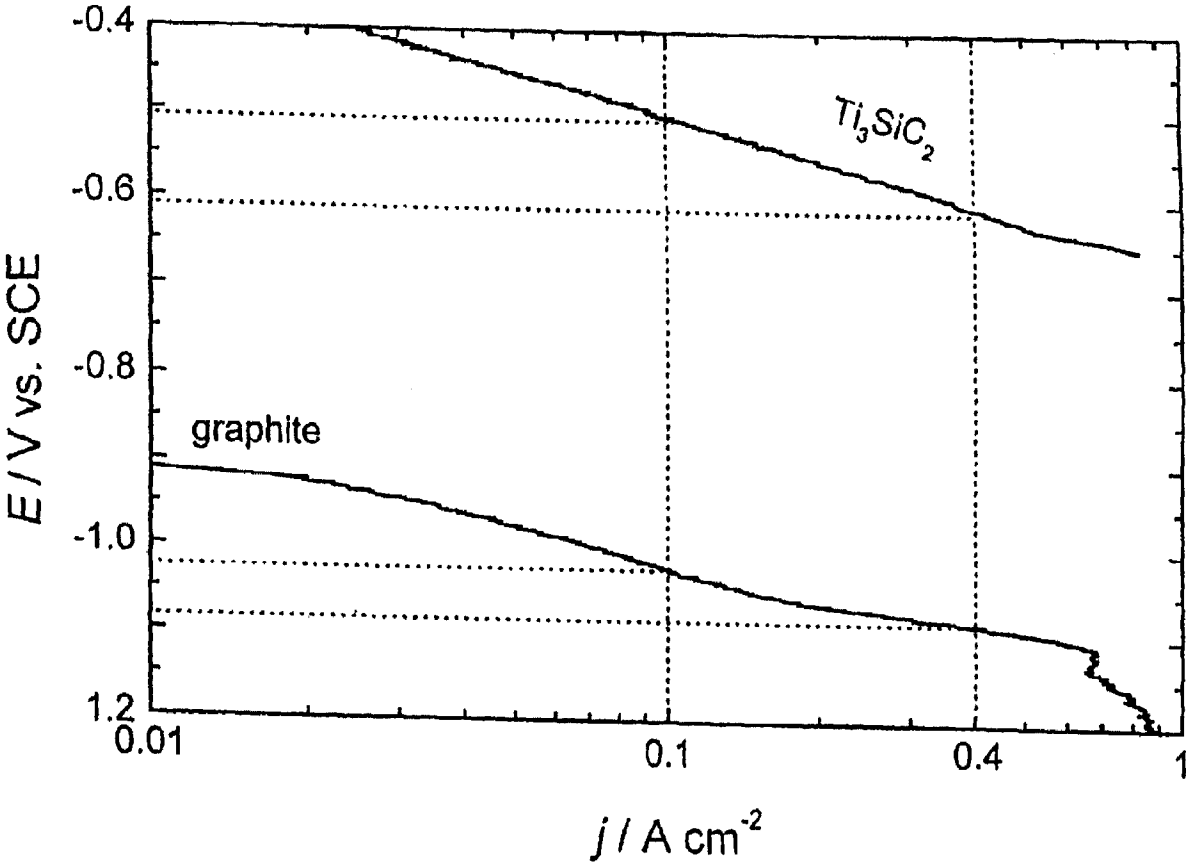
FIG. 2 shows a comparison of the cathodic polarization curves for graphite and $Ti_3SiC_2$ cathodes.

FIG. 2 shows the polarization curves (potential versus current density) of saturated calomel electrodes (SCE) for graphite and $Ti_3SiC_2$ (both bulk and plasma sprayed) cathodes in 22 percent hydrochloric acid solution at a room temperature after correction for IR drop, representing the true potential of cathodes as a function of current density during the hydrogen evolution reaction. FIG. 2 shows that in the whole range of current densities applied, over-voltage for hydrogen evolution onto both bulk and plasma sprayed $Ti_3SiC_2$ cathodes is about 0.5 V lower than that of a graphite cathode. FIG. 2 further shows that at the current density of 0.1 $A/cm^2$ (condition for electrolysis of hydrochloric acid in DeNora cells, see F. M. Berkey, "Electrolysis of Hydrochloric Acid Solutions", Ch. 7 in "Chlorine its Manufacture, Properties and Uses", Ed. J. S. Sconce, New York, Reinhold Publishing Corp. 1962) over-voltage for hydrogen evolution onto both bulk and plasma sprayed $Ti_3SiC_2$ cathodes is lower by about 0.52 V than that of graphite cathodes. FIG. 2 further shows that at the current density of 0.4 $A/cm^2$ (condition for electrolysis of hydrochloric acid in Uhde process) over-voltage for hydrogen evolution onto both bulk and plasma sprayed $Ti_3SiC_2$ cathodes is lower for about 0.47 V than on graphite cathodes. The $Ti_3SiC_2$ cathodes obtained as a bulk material, as well as plasma sprayed cathodes, have the same polarization curves.

A bulk $Ti_3SiC_2$ anode activated by a thermally prepared coating comprised of a solid solution of $TiO_2$ and $RuO_2$ was also compared with a commercial graphite anode in 22 percent hydrochloric acid solution. The commercial graphite anode was mechanically polished with fine emery paper (#800) and thoroughly rinsed with distilled water. The bulk $Ti_3SiC_2$ anode was roughened by sand blasting with sand particles of 50 $\mu$m. The roughened sample was thoroughly degreased in ethanol saturated with sodium hydroxide at room temperature. After rinsing with distilled water, the sample was etched in 25 percent nitric acid for 30 minutes at room temperature, rinsed thoroughly in distilled water and dried in hot air at about 50° C. The surface of the sample was then coated by brushing with the mixture of 70 mol. percent $TiCl_3$ and 30 mol. percent $RuCl_3$ dissolved in isopropanol to produce a solution containing 10 $g/dm^3$ based on pure metal in successive layers until the metal loading of 10 $g/m^2$ was attained (usually 5-8 layers). Each layer was dried at 50° C.

in air for 10 minutes and then heated in air in an electric furnace at 400° C. for about 10 minutes without ventilation. The final baking was carried out in an electric furnace at 400° C. for 60 minutes in static air conditions and then cooled to a room temperature under natural convection.

Figure 3:
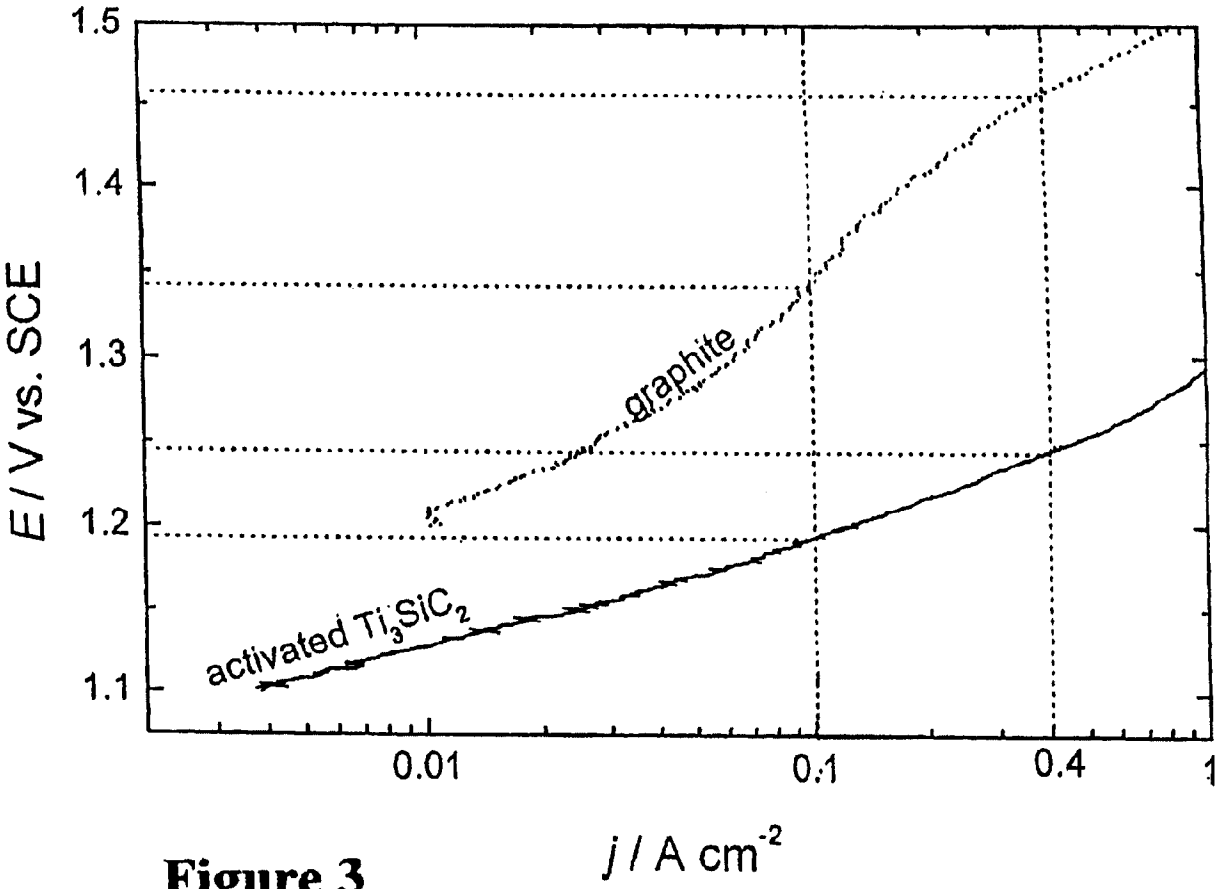
FIG. 3 shows a comparison of the anodic polarization curves for graphite and activated $Ti_3SiC_2$ anodes.

FIG. 3 shows the polarization curves (potential versus current density) measured for saturated calomel electrodes (SCE) of graphite and activated $Ti_3SiC_2$ anodes in 22 percent hydrochloric acid solution at room temperature after correction for IR drop, representing the true potential of anodes as a function of current density during the chlorine evolution reaction. FIG. 3 shows that in the whole range of current densities applied over-voltage for chlorine evolution onto activated $Ti_3SiC_2$ anodes is lower by about 0.08 V to 0.22 V than that of graphite anodes. FIG. 3 further shows that at the current density of 0.1 $A/cm^2$ (condition for electrolysis of hydrochloric acid in DeNora cells, see F. M. Berkey, "Electrolysis of Hydrochloric Acid Solutions", Ch. 7 in "Chlorine its Manufacture, Properties and Uses", Ed. J. S. Sconce, New York, Reinhold Publishing Corp. 1962) over-voltage for chlorine evolution onto activated $Ti_3SiC_2$ anode is lower by about 0.15 V than that of graphite anode. FIG. 3 further shows that at the current density of 0.4 $A/cm^2$ (condition for electrolysis of hydrochloric acid in Uhde process) overvoltage for chlorine evolution onto activated $Ti_3SiC_2$ anodes is lower by about 0.21 V than that of graphite anodes.

As demonstrated by the polarization curves, under the conditions of electrolysis used in Uhde process, the decreased voltage on the cell for electrolysis of hydrochloric acid obtained by replacing commercial graphite electrodes with the cathodes and anodes of the present invention is significant, equivalent to about 0.69 V.

What is claimed is:

1. A chlor-alkalielectrolytic cell for electrolysis of hydrochloric acid solutions, alkali metal halide solutions and alkaline solutions comprising a cathode and an anode wherein the cathode comprises a composition $M_{n+1}AX_n$, wherein M is a metal of group IIIB, IVB, VB, VIB or VIII of the periodic table of elements or a mixture thereof; wherein A is an element of group IIIA, IVA, VA or VIA of the periodic table of elements or a mixture thereof; and wherein X is carbon, nitrogen, or carbon and nitrogen, said cathode exhibiting lower over-voltage than a graphite cathode for hydrogen evolution.

2. The electrolytic cell of claim 1 wherein the composition is $Ti_3SiC_2$.

3. The electrolytic cell of claim 1 wherein the anode comprises a composition $M_{n+1}AX_n$, wherein M is a metal of group IIIB, IVB, VB, VIB or VIII of the periodic table of elements or a mixture thereof; wherein A is an element of group IIIA, IVA, VA or VIA of the periodic table of elements or a mixture thereof; and wherein X is carbon, nitrogen or carbon and nitrogen activated by a catalytic thermally prepared coating containing a mixture of $TiO_2$ and $RuO_2$ or a mixture of $TiO_2$, $RuO_2$ and $IrO_2$.

4. The electrolytic cell of claim 1 wherein the anode comprises a composition $Ti_{n+1}AX_n$, wherein A is an element of group IIIA, IVA, VA or VIA of the periodic table of elements or a mixture thereof; and wherein X is carbon, nitrogen or carbon and nitrogen activated by addition of Ru, or Ru and Ir in the bulk ceramic material during processing and subjected to subsequent oxidation, said anode exhibiting lower over-voltage than a graphite anode for chlorine evolution.

5. The electrolytic cell of claim 4 wherein the anode comprises $Ti_3SiC_2$ and Ru or Ru and Ir and exhibits lower over-voltage than a graphite anode for chlorine evolution.

6. A chlor-alkalielectrolytic cell for electrolysis of hydrochloric acid solutions, alkali metal halide solutions and alkaline solutions comprising a cathode of a material suitable for formation of a cathode coated with a material comprising composition $M_{n+1}AX_n$, wherein M is a metal of group IIIB, IVB, VB, VIB or VIII of the periodic table of elements or a mixture thereof; wherein A is an element of group IIIA, IVA, VA or VIA of the periodic table of elements or a mixture thereof; and wherein X is carbon, nitrogen or carbon and nitrogen, said cathode exhibiting lower over-voltage than a graphite cathode for hydrogen evolution.

7. A chlor-alkalielectrolytic cell for electrolysis of hydrochloric acid solutions, alkali metal halide solutions and alkaline solutions comprising a cathode and an anode wherein the cathode is coated with $Ti_3SiC_2$ and the cathode exhibits lower over-voltage for hydrogen evolution than a graphite cathode.

* * * * *